US006758151B2

(12) United States Patent
Braithwaite et al.

(10) Patent No.: US 6,758,151 B2
(45) Date of Patent: Jul. 6, 2004

(54) REMOTELY ACTIVATED ARMORED INCINERATOR WITH GAS EMISSION CONTROL

(75) Inventors: Tom W. Braithwaite, Ancaster (CA); Derick R. Ivany, Ottawa (CA)

(73) Assignee: Her Majesty the Queen in right of Canada, as represented by the Royal Canadian Mounted Police, Ottawa (CA)

( * ) Notice: Subject to any disclaimer, the term of this patent is extended or adjusted under 35 U.S.C. 154(b) by 0 days.

(21) Appl. No.: 10/242,764

(22) Filed: Sep. 13, 2002

(65) Prior Publication Data

US 2003/0051648 A1 Mar. 20, 2003

Related U.S. Application Data

(60) Provisional application No. 60/318,823, filed on Sep. 14, 2001.

(51) Int. Cl.[7] ..... F23G 7/00; F23B 1/12

(52) U.S. Cl. ..... 110/237; 110/322; 110/295

(58) Field of Search ..... 110/240, 165 R, 110/326, 237, 322, 315, 316, 225, 295, 169, 167

(56) References Cited

U.S. PATENT DOCUMENTS

| | | | | |
|---|---|---|---|---|
| 3,772,958 A | | 11/1973 | Mullarkey | 86/1 |
| 3,792,671 A | | 2/1974 | Woods | 110/8 |
| 3,903,814 A | | 9/1975 | Altekruse | 110/18 |
| 4,655,968 A | * | 4/1987 | Quieser et al. | 252/632 |
| 4,688,494 A | | 8/1987 | Domnitch | 110/240 |
| 4,852,815 A | | 8/1989 | Giannotti | 241/65 |
| 5,135,130 A | | 8/1992 | Andrews | 220/260 |
| 5,495,812 A | | 3/1996 | Schulze | 110/237 |
| 5,606,923 A | | 3/1997 | Fujimori | 110/211 |
| 5,727,481 A | | 3/1998 | Voorhees et al. | 110/237 |
| 6,173,662 B1 | | 1/2001 | Donovan | 110/237 |
| 6,352,040 B1 | | 3/2002 | Voorhees et al. | 110/237 |
| 6,354,181 B1 | | 3/2002 | Donovan | 86/50 |

FOREIGN PATENT DOCUMENTS

| | | |
|---|---|---|
| CA | 3307507 | 3/1967 |
| CA | 2185646 | 3/1995 |
| WO | WO/99/23419 | 5/1999 |

OTHER PUBLICATIONS http://www.remtc.com/equipment.html.
http://www.remtc.com/equipment/MobileTDU–1.html.
http://www.remtc.com/equipment/httMTDU–2.html.
http://www.nabcoinc.com/special_products.htm.
http://www.hnd.usace.army.mil/oew/news/blast.html.

* cited by examiner

*Primary Examiner*—Kenneth B. Rinehart
(74) *Attorney, Agent, or Firm*—Marks & Clerk

(57) ABSTRACT

An incinerator, capable of withstanding internal shocks from projectiles resulting from the combustion of energetic materials, is made of a primary combustion chamber where the material is burned, and a secondary chamber to reburn at a higher temperature the gases emanating from the primary chamber. The incinerator has a heating or separation plate, having a flowing-material funnel facilitating the removal of waste solids, to provide heat exchange between the primary combustion chamber and a heating chamber, to protect the heating elements against projectiles, and to restrain any projectiles from exiting the unit. To increase the level of safety of operation, this incinerator is remotely controlled, has a sequence of ignition and has overpressure apertures over the primary chamber.

12 Claims, 4 Drawing Sheets

REMOTELY ACTIVATED ARMORED INCINERATOR WITH GAS EMISSION CONTROL

CROSS-REFERENCE TO RELATED APPLICATION

This application claims the benefit of U.S. Provisional Application No. 60/318,823 filed Sep. 14, 2001, incorporated by reference herein.

FIELD OF THE INVENTION

This invention relates to an incinerator, and more particularly to an incinerator which provides safe operation and efficient disposal of hazardous, explosive or illicit materials and which can withstand internal shocks.

BACKGROUND OF THE INVENTION

Disposal of hazardous, explosive or illicit materials requires a unit which can be displaced in order to burn the material at a site or near a site where the material is stacked. This alleviates hazards and costs related to transporting the material off site.

In the past, it was common to dig a pit, place the contraband in the pit, pour accelerant over the material and burn it. This method has been deemed totally unacceptable as it generates unrestrained noise and pollution from known pollutants, such as lead, antimony, potassium nitrate, sodium nitrate and sulfur. There is also a threat of various unknown pollutants due to the diversity of material that can be processed, including various heavy metals and organic chemicals, such as nitrocellulose, nitroglycerine and DBP (plasticizer).

Another known method of burning ammunition makes use of an open drum that contains two trays with fissures. In the bottom tray, fuel in the form of fuel oil and wood shavings are added, and the ammunition is added to the top tray. During the burning process, part of the low boiling metals are melted and fall through the tray fissures and into the drum bottom. Due to the explosive nature of the material, pollutants are emitted into the air and eventually fall to the ground.

An ammunition incinerator, known as the "Hurd" burner from the Hurd's Custom Machinery Inc. has a reinforced body, defining a single combustion chamber, in the shape of a fuel tank. The burner fires directly in the combustion chamber and there is no reburn system. This unit generates a lot of smoke, which contains noxious gases from the ammunition. Also the manual ignition of this device leaves too much room for error, causing structural damage at the door and being hazardous for the operator.

U.S. Pat. No. 5,727,481, issued on Mar. 17, 1998 discloses a mobile armored incinerator for similar uses, which provides pressure release hatches and a reburn system, but the latter is not integrally built in the body. The burners fire directly in the primary chamber and there are air intakes in direct communication with the primary chamber. This leaves many exposed parts which may be hit by projectiles, or gaps from which projectiles can escape. Also, the loading cart does not provide material separation.

In general, incinerators are designed to be used with regular refuse material. Typically, their internal walls are made of refractory material, and they do not include armored panels nor overpressure hatches to cushion possible sudden blows.

Therefore there is a need for an incinerator which alleviates some of the disadvantages of the prior art.

SUMMARY OF THE INVENTION

This invention relates to an incinerator capable of withstanding internal shocks resulting from the combustion of the material to be burned.

Thus, according to one aspect, the invention provides an incinerator capable of withstanding internal shocks resulting from combustion of material to be burned, the incinerator comprising a body including a primary combustion chamber for burning the material, a heating chamber for providing heat to the combustion chamber, and a bullet proof separation plate providing separation between the primary combustion chamber and the heating chamber to prevent projectiles from escaping, and providing sufficient heat exchange between the primary combustion chamber and the heating chamber.

There are many advantages in using an incinerator according to the invention. First, by containing projectiles emitted during the combustion process, and therefore various pollutants, that are propelled into the air, contact of the pollutants with the ground is eliminated, which in turn controls the environmental impact on soil, water and air. Also, by burning at high temperatures, combustion efficiency is improved and the levels of emitted pollutants to the air may be decreased.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE INVENTION

Figure 1:
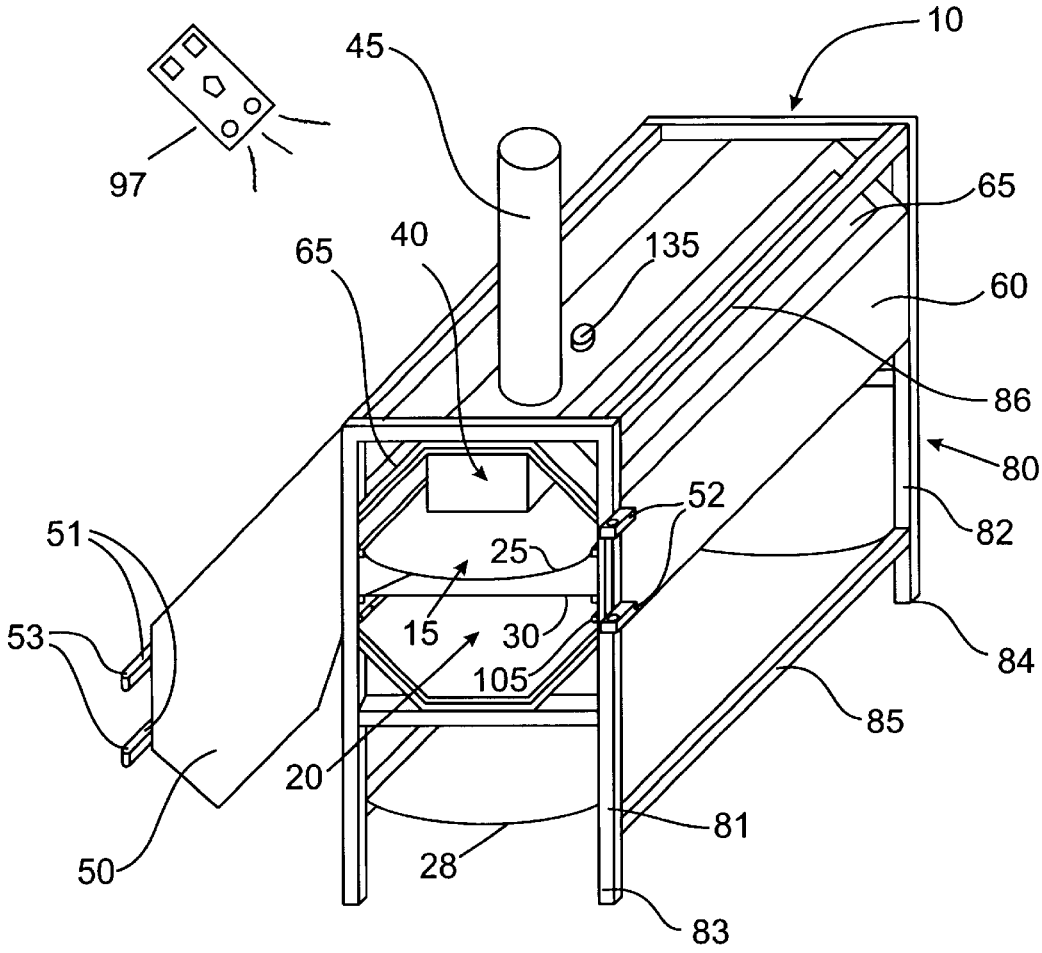
FIG. 1 is a front perspective view of the incinerator in accordance with this invention with the door opened to show some interior elements.

Referring to FIG. 1, there is illustrated an armored incinerator 10, having a generally cylindrical body 60, closed at one end and open at the other end. The open end is adapted to be closed by a door 50. The body 60 includes a primary combustion chamber 15, and a heating chamber 20 having first heating means 105.

Figure 2:
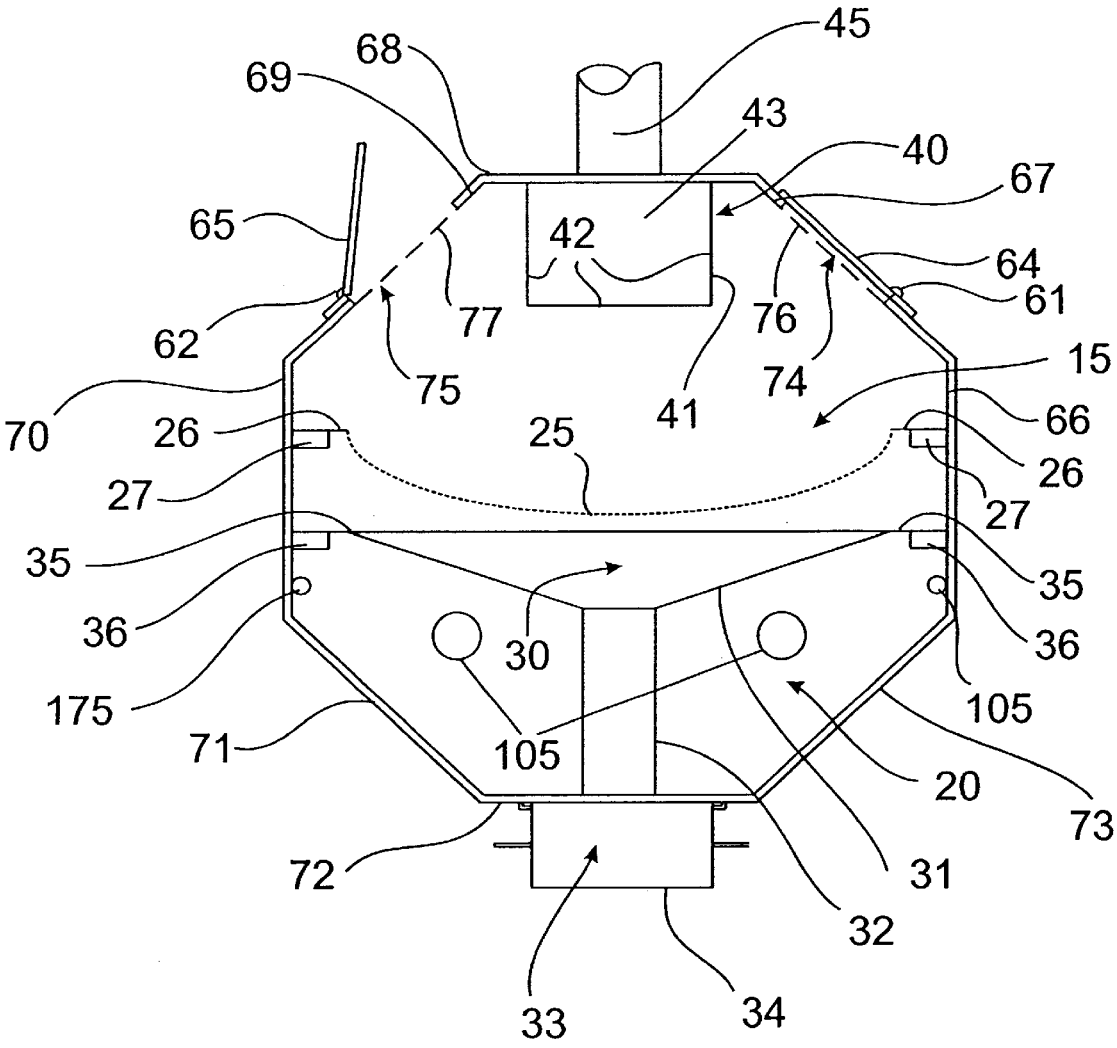
FIG. 2 is a front view of the incinerator of FIG. 1 with the door removed to show constructional details.

The primary combustion chamber 15 includes a support means, preferably in the form of a loading tray 25, where the material to be burned is fed. There are also air intakes 175 (seen in FIG. 2) to allow ambient air to pass into the primary combustion chamber via the heating chamber. A secondary combustion chamber 40 is located in an upper portion of the primary chamber 15 and has a second heating means 120 (seen in FIG. 3), and an exhaust vent 45. A heating plate, or separation plate, 30 separates the primary combustion chamber 15 from the heating chamber 20. The heating plate 30 serves to provide a heat exchanging means between the heating chamber 20 and the primary combustion chamber 15, and to distribute the heat evenly from the heating chamber 20 in the primary combustion chamber 15. Plate 30 also prevents projectiles, which result from the combustion, from escaping the primary combustion chamber 15 via the air intakes 175.

Figure 3:
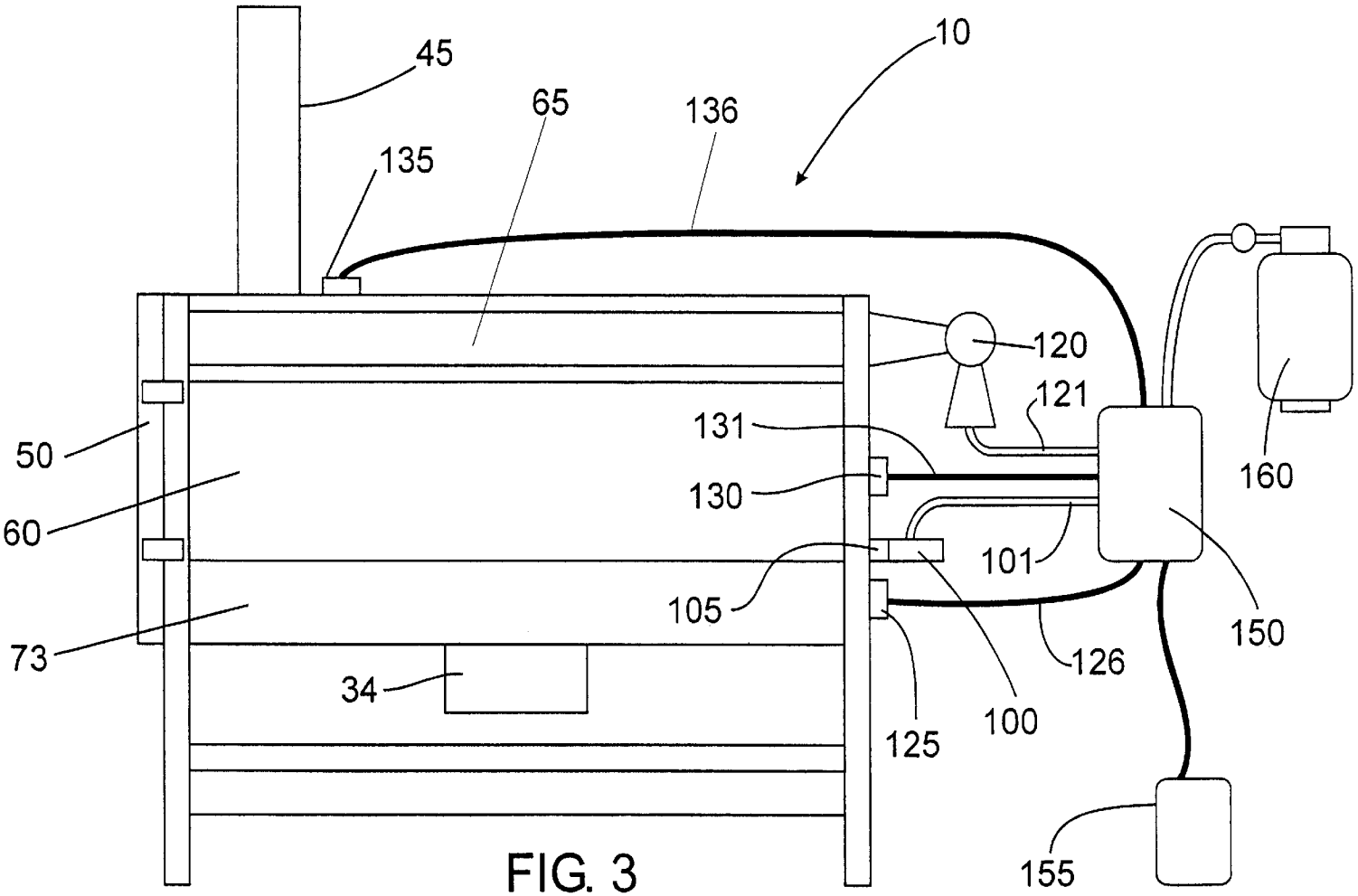
FIG. 3 is a side view of the incinerator showing constructional details and a schematic of the gas circuit.

The first heating means 105 is in the form of heating elements in communication with external primary gas burners 100 (seen in FIG. 3). The second heating means 120 is in the form of external gas burner in communication with the secondary combustion chamber 40. Propane gas or natural gas can be used interchangeably, either from a gas tank 160 or directly from a source line. Electrical means can be used instead of gas burner without departing from the scope of the invention.

Referring to FIGS. 1 and 3, the body 60 of the incinerator unit comprises several panels 66 to 73 welded, or secured by expansion joints, to form a polygon in cross-section. It will be appreciated that the incinerator can be of various proportions and sizes to be adapted to different situations. In one embodiment, these panels form an octagon, however other shapes such as hexagon, heptagon or dodecagon can be used without departing from the invention. Two of these panels 66, 70 are vertically disposed to form opposite sides of the body 60. These panels are welded, or otherwise fastened, to the extensions 81, 82 of the frame. The two upper corner panels 67, 69 adjacent and disposed over the vertical panels 66, 70 converge to either the next panel 68 (to form an octagon), to the next panels (to form a decagon, not shown), or to a common joint (to form a hexagon or heptagon, not shown).

The upper corner panels 67, 69 each have a pressure control means to control the pressure in the primary combustion chamber 15, comprising overpressure apertures 74, 75 each covered by a hinged panel 64, 65. The hinged panels 64, 65 have hinge means 61, 62 on one side, and can sit by gravity over their respective upper corner panels 67, 69 or have means to remove or add some weight to the hinged panel depending on the side and weight of the latter. This is dependent upon the pressure limit which is considered as unsafe operation. In this embodiment, the right hinged panel 64 is shown in a closed position, and the left hinged panel 65 is shown in an open position. Steel or other high impact material screen 76, 77 covers the inside of the overpressure apertures 74, 75 to prevent projectiles to escape the unit in the event that the overpressure panels 64, 65 have to open in operation.

Tray supports 27 and plate supports 36, each inside the vertical panels 66, 70 removably retain respectively, the loading tray 25 and the heating plate 30. These supports 27, 36 can be an integral part of the vertical panels 66, 70, or can be a separate element welded, or otherwise fastened, to the vertical panels 66, 70. The loading tray 25 has perforations to permit the material in fusion or in sub-fluidic state to flow through or pass through these perforations and to fall on the heating plate 30. The loading tray 25 also has lips 26 which cooperate with the tray supports 27, to allow the loading tray to be removable. Generally, the loading tray 25 slides in and out of the unit, with the material to be burned disposed upon the loading tray 25.

Figure 4:
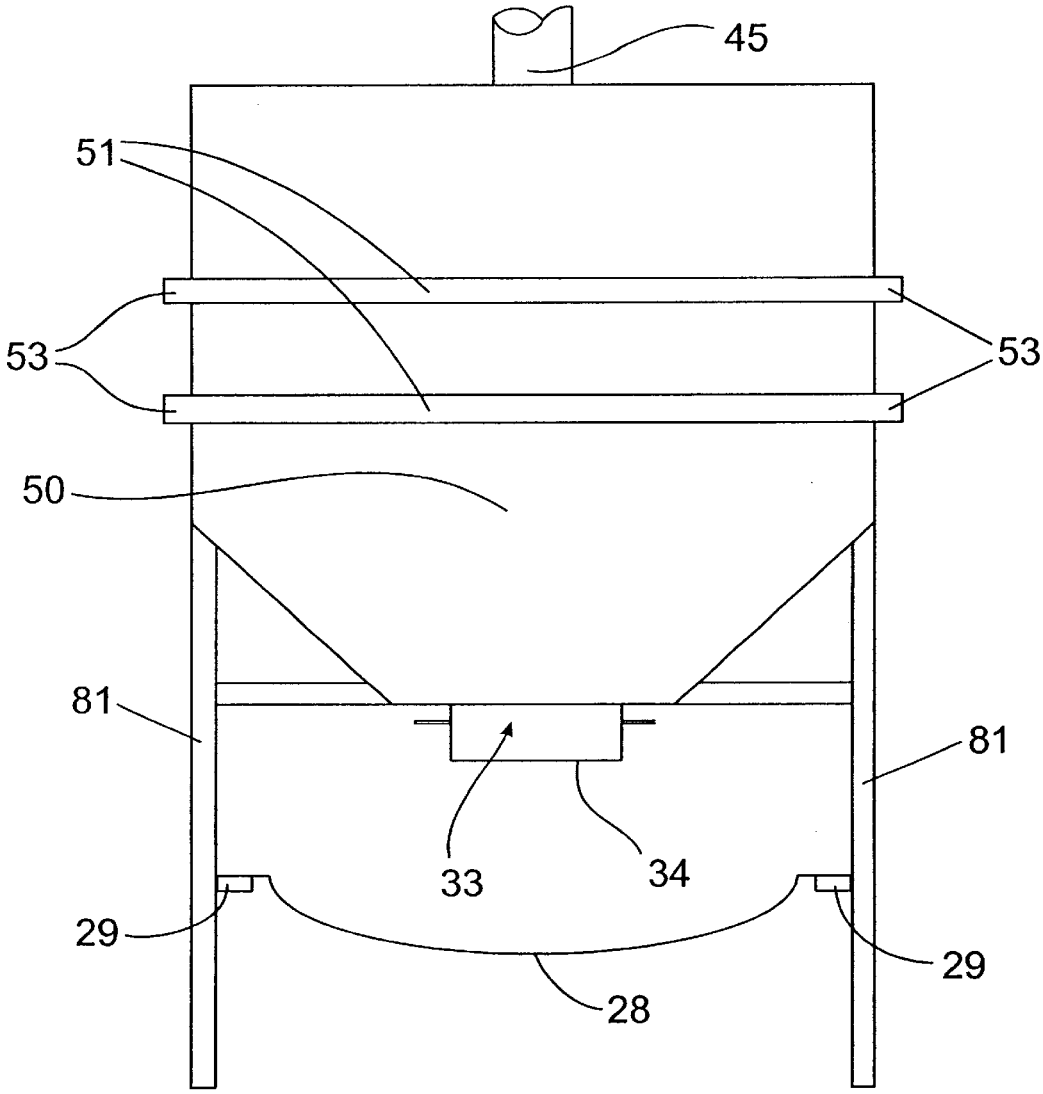
FIG. 4 is a front view of the incinerator with the door closed.

A second tray 28 (seen in FIG. 4) is also supported in the bottom part of the frame, by sliding over supports 29 (seen in FIG. 4). Tray 28 can be used for a second load of material to be processed. Generally, tray 28 is removed from the incinerator while the material in tray 25 is being combusted, so that resulting debris may fall from heating plate 30. Also, when a burn has just finished, it is possible to use these supports 29 to let the tray 25, coming from the primary combustion chamber 40, cool down before any other manipulation.

The heating plate 30 is curved or sloped, from the front view, to force the material having passed through the loading tray 25, usually the material having lower fusion temperature, to a central funnel portion 31 in the heating plate 30. The heating plate 30 is also curved or sloped, perpendicularly from the front view, to force the same material to converge to this funnel portion 31. The funnel portion 31 is in communication with a passage 32 adjacent to, and heated by, the first heating means 105 so that the material is in a flowable state. The material flows out of the body 60, by an aperture 33 in the bottom plate 72, to a collecting bin 34 under the unit. The bin 34 can be of various designs, from a single use bin to a mold to form ingots. The other part of the burned material (usually of higher fusion temperature and bigger dimension) remains on the loading tray 25, which is removed after a burn to be cleaned for the next batch.

A box 41 insulates the primary combustion chamber 15 from the secondary combustion chamber 40. This box 41 can be formed by a panel (for hexagonal or heptagonal units, not shown), or panels 42 (for octagonal or decagonal units), and the top panels of the body (for hexagonal or heptagonal units, not shown), or the top panel 68 of the body (for octagonal or decagonal units). The box 41 is closed at the front end by a panel 43 and opened at the back end to permit the flow of the gases exiting or emanating from the primary combustion chamber into the secondary combustion chamber 40, where the exhaust gases are burned off at a higher temperature and for the passage of the secondary burning element 120 (seen in FIG. 3). Exhaust gas from the secondary combustion chamber 40 exits through an aperture in the top panel 68 (for octagonal or decagonal units) or at the intersection of the top panels (for hexagonal or heptagonal units), adjacent to the front end of the box, through the exhaust vent 45, such as a catalytic converter or a simple chimney.

All the internal walls of the primary combustion chamber 15 can be covered by stainless steels sheets or with any other heat resistant material capable of withstanding high impact. These sheets may be applied inside the top part of the vertical panels 66, 70, of the upper corner panels 67, 69, the top panel 68 and the hinged panels 64,65. In this way, the material of the panels 64 to 73 of the body 60 can resist penetration by most projectiles. The outside walls of the secondary combustion chamber 40 may be insulated on the inside in order to retain the heat during operation.

Referring to FIGS. 1 and 3, the first heating means 105 of the primary combustion chamber 15 are fed from the gas burners 100 (typically, one on each side). A local control manifold 150 regulates the flow of gas, from the information given by the user via a remote control unit 155 and from temperature sensors, such as thermocouples 125, 130, 135. The local control manifold 150 incorporates the necessary control valves and regulators (not shown) disposed according rules and standards of gas installations as known in the art. From this circuitry, the gas burners 100 and the secondary gas burning element 120 are fed with gas using gas lines 101, 121 respectively. Thermocouples 125, 130, 135 are disposed in some or all the chambers to detect undesirable temperature variations, these thermocouples are linked to the local control manifold 150 by heat resistant electrical cables 126, 131, 136, respectively. Control means (not shown) in the local control manifold 150 regulates the flow of gas from signals received from the thermocouples 125, 130, 135 and from other sensors which can be also incorporated to detect other parameters, such as pressure, presence of specific gas, velocity of gases, etc.

With the local control manifold 150 and the remote control unit 155, the operator can start/ignite or stop the incinerator from a safe distance. Also by having a simple means for ignition the operator can pay more attention to the surrounding of the unit to detect any sign of hazard.

The incinerator can be mounted on extensions 81, 82 of a supporting frame 80 on each side of the body, to be supported by the leg parts 83, 84, and then be transported from site to site by hoisting the unit by the frame elements on each side of the body, for example frame elements 85. Also, any part of the frame 81 to 87 can be secured, fastened or welded to a structure, such as a trailer, a sleigh, a barge, or even to a fixed structure, if needed. These installations will have to be done according to applicable safety standards and leaving enough room around the unit for heat dissipation.

Referring now to FIG. 4, the front end of the body 60 is closed during operation of the incinerator by a door 50, which can also preferably, totally cover the top part of the frame. One solution to obtain a blast resistant door is to have reinforcement bars 51 over the door having extensions 53 on each side. These extensions 53 cooperate with similar extensions 52 (seen in FIG. 1) on each side 81 of the frame.

The door may include hinges on one side for improved strength. Also, an electric shut-off (not shown) may be included as a safety measure to shut off the propane in the event that the door opens.

Also, there may be included a fan and airduct (not shown) mounted to the incinerator and cooperating with the heating chamber. The fan may be remotely operated by remote control unit 97 to speed up the cooling process of the incinerator after the burning process. This will allow the next load of material to be loaded up and burned sooner.

Numerous modifications may be made without departing from the spirit and scope of the invention as defined in the appended claims.

What is claimed is:

1. An incinerator for burning a charge of potentially explosive material and capable of withstanding internal shocks resulting from the combustion of such material, comprising:

an armored primary combustion chamber;

a tray in said primary combustion chamber for supporting the charge of material to be burned, said tray having an aperture through which the material falls after combustion by gravity;

a heating chamber including a source of heat;

an armored heating plate located between the primary combustion chamber and the heating chamber for providing heat exchange between the heating chamber and the primary combustion chamber to permit combustion of the charge of material in the combustion chamber, said armored heating plate preventing projectiles from escaping from the combustion chamber into the heating chamber; and a conduit opening through said heating plate into the combustion chamber for evacuating from said combustion chamber burned material falling through said aperture.

2. The incinerator of claim 1, further comprising a secondary combustion chamber, which burns exhaust gases emanating from the primary combustion chamber, at a higher temperature.

3. The incinerator of claim 2, further comprising a box to facilitate the flow of exhaust gases emanating from the primary combustion chamber to the secondary combustion chamber.

4. The incinerator of claim 1, further comprising air intakes to allow ambient air to pass into the primary combustion chamber via the heating chamber, the air intakes being positioned such that the heating plate prevents projectiles resulting from combustion of the material to be burned from escaping the primary combustion chamber.

5. The incinerator of claim 1, further comprising a second loading tray for loading a second load of material to be burned.

6. The incinerator of claim 1, wherein the aperture has a funnel portion to facilitate material removal.

7. The incinerator of claim 1, further comprising pressure control means for controlling the pressure in the primary combustion chamber.

8. The incinerator of claim 7, wherein the pressure control means includes a least one overpressure aperture over the primary combustion chamber, and a hinged panel covering the at least one overpressure aperture to relieve any undesirable over pressure.

9. The incinerator of claim 1, wherein the incinerator comprises panels made of a material which can resist penetration by projectiles resulting from combustion of the material to be burned.

10. The incinerator of claim 1, further comprising a control means to control combustion within the incinerator by regulating the flow of gas into the primary combustion chamber.

11. The incinerator of claim 1, further comprising a remote control unit to allow a user to operate the incinerator remotely.

12. The incinerator of claim 1, further comprising means for transporting the incinerator.

* * * * *